US008721048B2

(12) United States Patent
Yasuda et al.

(10) Patent No.: US 8,721,048 B2
(45) Date of Patent: May 13, 2014

(54) SUBSTRATE FOR LIQUID DISCHARGE HEAD AND LIQUID DISCHARGE HEAD

(71) Applicant: Canon Kabushiki Kaisha, Tokyo (JP)

(72) Inventors: Takeru Yasuda, Oita (JP); Takuya Hatsui, Tokyo (JP); Makoto Sakurai, Kawasaki (JP); Soichiro Nagamochi, Yokohama (JP); Souta Takeuchi, Fujisawa (JP); Yuzuru Ishida, Yokohama (JP); Kazuaki Shibata, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/898,332

(22) Filed: May 20, 2013

(65) Prior Publication Data

US 2013/0314474 A1 Nov. 28, 2013

(30) Foreign Application Priority Data

May 22, 2012 (JP) ..... 2012-116935
Apr. 22, 2013 (JP) ..... 2013-089846

(51) Int. Cl.
*B41J 2/05* (2006.01)

(52) U.S. Cl.
USPC ..... 347/61; 347/63; 347/64

(58) Field of Classification Search
USPC ..... 347/61, 63, 64
See application file for complete search history.

(56) References Cited

U.S. PATENT DOCUMENTS 8,587,624 B2 * 11/2013 Nakagawa et al. ..... 347/200
2004/0125174 A1 7/2004 Anderson

FOREIGN PATENT DOCUMENTS

JP 2000-225708 A 8/2000
WO 2002/098665A A1 12/2002

* cited by examiner

*Primary Examiner* — Lisa M Solomon
(74) *Attorney, Agent, or Firm* — Canon U.S.A., Inc., IP Division

(57) ABSTRACT

The reduction in reliably of a liquid discharge head due to the dissolution of a protective layer is suppressed. A substrate for a liquid discharge head includes a base substrate, a heat-generating resistive layer placed on the base substrate, a pair of lines placed on the base substrate, and a protective layer covering the heat-generating resistive layer and the lines. The protective layer contains a material represented by the formula $Si_xC_yN_x$, where x+y+z=100, 30≤x≤59, y≥5, and z≥15 on an atomic percent basis.

6 Claims, 6 Drawing Sheets

SUBSTRATE FOR LIQUID DISCHARGE HEAD AND LIQUID DISCHARGE HEAD

BACKGROUND OF THE INVENTION

1. Field of the Invention

The present invention relates to a substrate for a liquid discharge head for discharging liquid and a liquid discharge head.

2. Description of the Related Art

One of recording methods using inkjet heads typified by liquid discharge heads is a method in which bubbles are generated by heating ink with a heat-generating element and the ink is discharged using the bubbles.

Japanese Patent Laid-Open No. 2000-225708 discloses that a plasma SiN film formed by a chemical vapor deposition (CVD) process is used as a protective insulation layer for protecting a heat-generating element and wiring lines for driving the heat-generating element from ink.

An inkjet head in which the plasma SiN film disclosed in Japanese Patent Laid-Open No. 2000-225708 is used as a protective layer can be sufficiently protected from conventional ink. However, in recent years, various types of inks have been used for the purpose of enhancing ink properties such as color developability in printing by inkjet printers, weather resistance, and fixability to paper. Among these inks, there are some inks which dissolve protective layers, made of plasma SiN or plasma SiO, used for substrates for conventional inkjet heads.

In the case where a protective layer is dissolved in ink, a current may possibly flow into an energy-generating element generating energy for discharging the ink or a wiring line through the ink. This may possibly cause disconnection. Alternatively, the energy-generating element may possibly react with oxygen contained in the ink to cause disconnection. Therefore, there is a problem in that the reliably of an inkjet head is reduced by the dissolution of the protective layer.

Protective layers for substrates for inkjet heads need to meet performance requirements such as insolubility in ink, adhesion to a passage-forming member, electrical insulation, and processability.

SUMMARY OF THE INVENTION

The present invention provides a substrate for a liquid discharge head. The substrate meets performance requirements, such as adhesion to a passage-forming member, electrical insulation, and processability, for protective layers and can suppress the reduction in reliably of a liquid discharge head due to the dissolution of a protective layer.

A substrate for a liquid discharge head according to the present invention includes a base substrate, a heat-generating resistive layer placed on the base substrate, a pair of lines placed on the base substrate, and a protective layer covering the heat-generating resistive layer and the lines. The protective layer contains a material represented by the formula $Si_xC_yN_x$ where $x+y+z=100$, $30 \leq x \leq 59$, $y \geq 5$, and $z \geq 15$ on an atomic percent basis.

According to the present invention, a substrate for a liquid discharge head can be provided. The substrate meets performance requirements, such as adhesion to a passage-forming member, electrical insulation, and processability, for protective layers and can suppress the reduction in reliably of a liquid discharge head due to the dissolution of a protective layer.

Further features of the present invention will become apparent from the following description of exemplary embodiments with reference to the attached drawings.

DESCRIPTION OF THE EMBODIMENTS

Figure 1A:
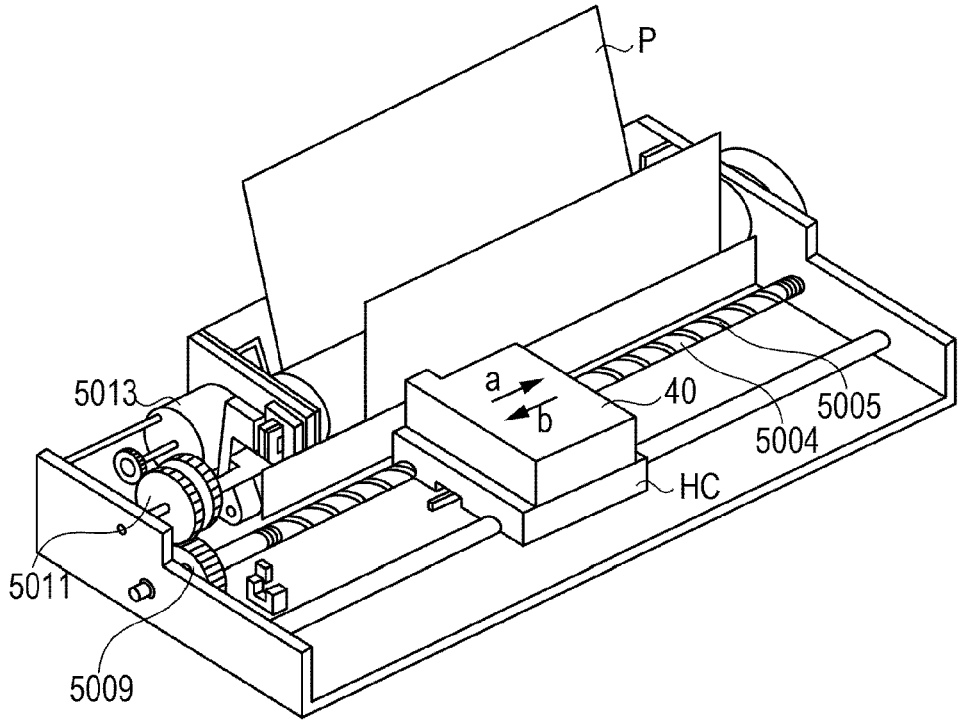
FIG. 1A is a schematic view of a liquid discharge apparatus in which a head unit including a liquid discharge head according to the present invention.

Liquid discharge heads can be installed in apparatuses such as printers, copiers, facsimile machines equipped with communication systems, and word processors including printer sections and industrial recording apparatuses combined with various composite processors. The use of the liquid discharge heads enables recording on various recording media such as paper, thread, fiber, fabric, leather, metal, plastic, glass, wood, and ceramic.

The term "recording" as used herein means that a meaningful image such as a letter or a figure is applied to a recording medium and also means that a meaningless image such as a pattern is applied to a recording medium.

The term "liquid" as used herein should be broadly construed and refers to not only ink used for recording but also liquid, applied to a recording medium, for forming an image, a design, a pattern, or the like; for processing a recording medium; or for treating ink or recording medium. The term "treating ink or recording medium" as used herein refers to, for example, treatment for enhancing fixability by solidifying or insolubilizing a colorant in ink applied to a recording medium, for enhancing recording quality or color developability, or for enhancing the durability of an image. A liquid for use in a liquid discharge apparatus according to the present invention usually contains a large amount of an electrolyte and is conductive.

Embodiments of the present invention will now be described with reference to the attached drawings. In description below, members having the same function are denoted by the same reference numerals in the drawings.

Liquid Discharge Apparatus

FIG. 1A is a schematic view of a liquid discharge apparatus. As shown in FIG. 1A, a lead screw 5004 rotates synchronously with the forward or reverse rotation of a driving motor 5013 through driving force transmitting-gears 5009 and 5011. A carriage HC includes a pin (not shown) engaged with a helical groove 5005 of the lead screw 5004 and is reciprocated in directions indicated by Arrows a and b. A head unit 40 is mounted on the carriage HC.

Head Unit

Figure 1B:
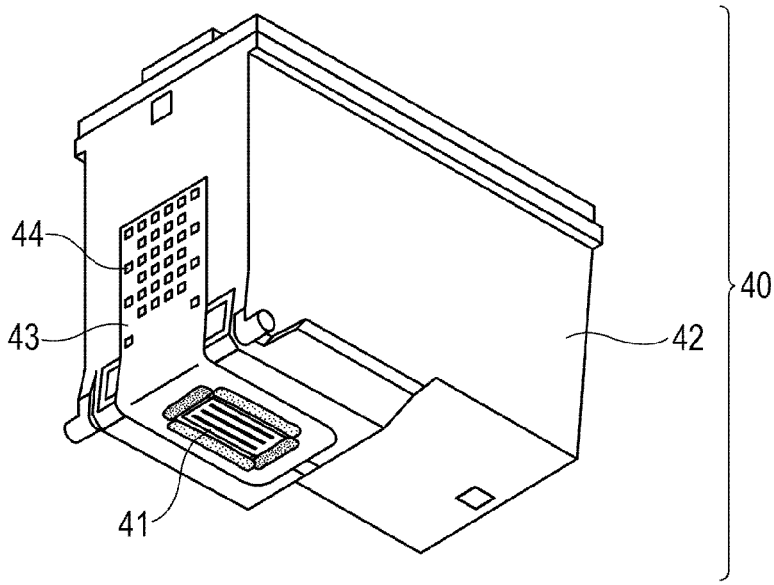
FIG. 1B is a perspective view of the head unit which can be installed in the liquid discharge apparatus shown in FIG. 1A.

FIG. 1B is a perspective view of the head unit 40, which can be installed in the liquid discharge apparatus shown in FIG. 1A. A liquid discharge head (hereinafter also referred to as head) 41 is electrically connected to contact pads 44, connected to the liquid discharge apparatus, through a flexible film wiring board 43. The head 41 and an ink tank 42 integrated therewith by bonding form the head unit 40. The head unit 40 is one formed by integrating the ink tank 42 with the head 41 and may be a separable type capable of separating the ink tank.

Liquid Discharge Head

Figure 2A:
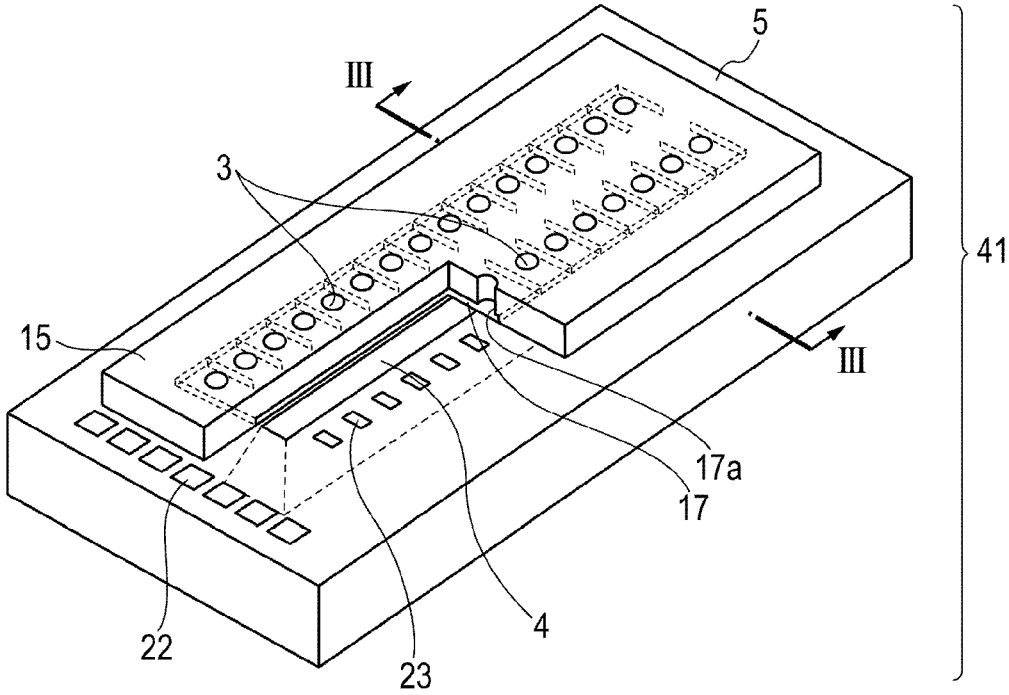
FIG. 2A is a perspective view of the liquid discharge head according to the present invention.

FIG. 2A is a perspective view of the liquid discharge head 41 according to the present invention. The liquid discharge head 41 includes a substrate 5 for a liquid discharge head and a passage wall member 15, placed on the substrate 5 for the liquid discharge head, serving as a passage-forming member. The substrate 5 for the liquid discharge head includes energy-generating elements 23 generating energy used to discharge liquid.

The passage wall member 15 may be made of a cured product of a thermosetting resin material such as an epoxy resin and has discharge ports 3 for discharging liquid and a wall 17*a* of a passage 17 communicating with the discharge ports 3. The liquid discharge head 41 has the passage 17, which is formed by bringing the substrate 5 for the liquid discharge head into contact with a surface of the passage wall member 15 that is opposite to the discharge ports 3. In the passage wall member 15, the discharge ports 3 are arranged along a supply port 4 extending through the substrate 5 for the liquid discharge head at a predetermined pitch so as to form rows.

Liquid supplied from the supply port 4 is supplied to the passage 17 and is then film-boiled due to thermal energy generated by the energy-generating elements 23, whereby bubbles are created. The liquid is discharged from the discharge ports 3 by the pressure generated thereby, whereby recording is performed.

The liquid discharge head 41 includes a plurality of terminals 22 for electrical connection. VH potentials for driving the energy-generating elements 23, ground potentials (GND potentials), or logic signals for controlling driving elements are transmitted from the liquid discharge apparatus to the terminals 22.

Figure 2B:
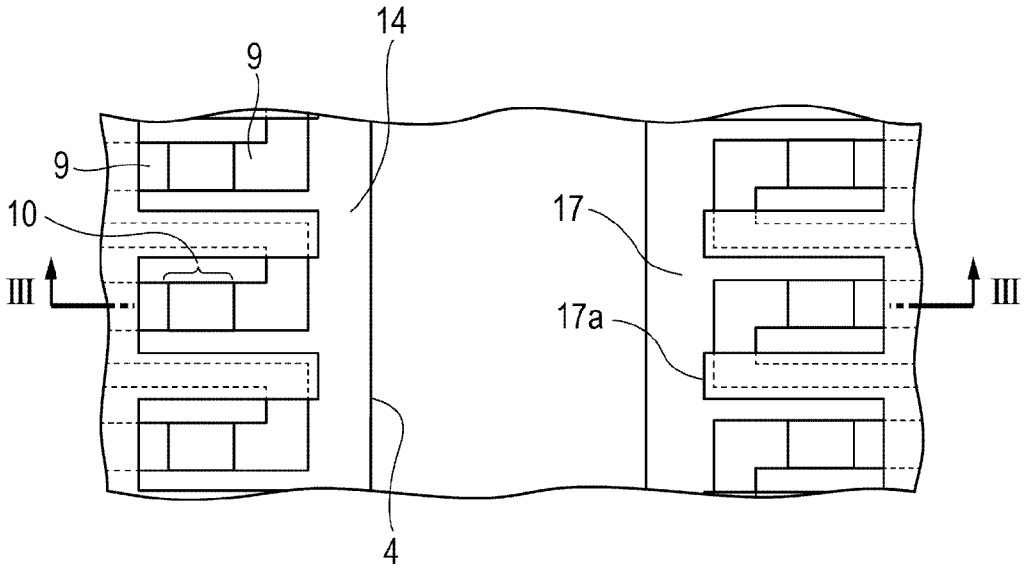
FIG. 2B is a schematic top view of the liquid discharge head according to the present invention.
Figure 3:
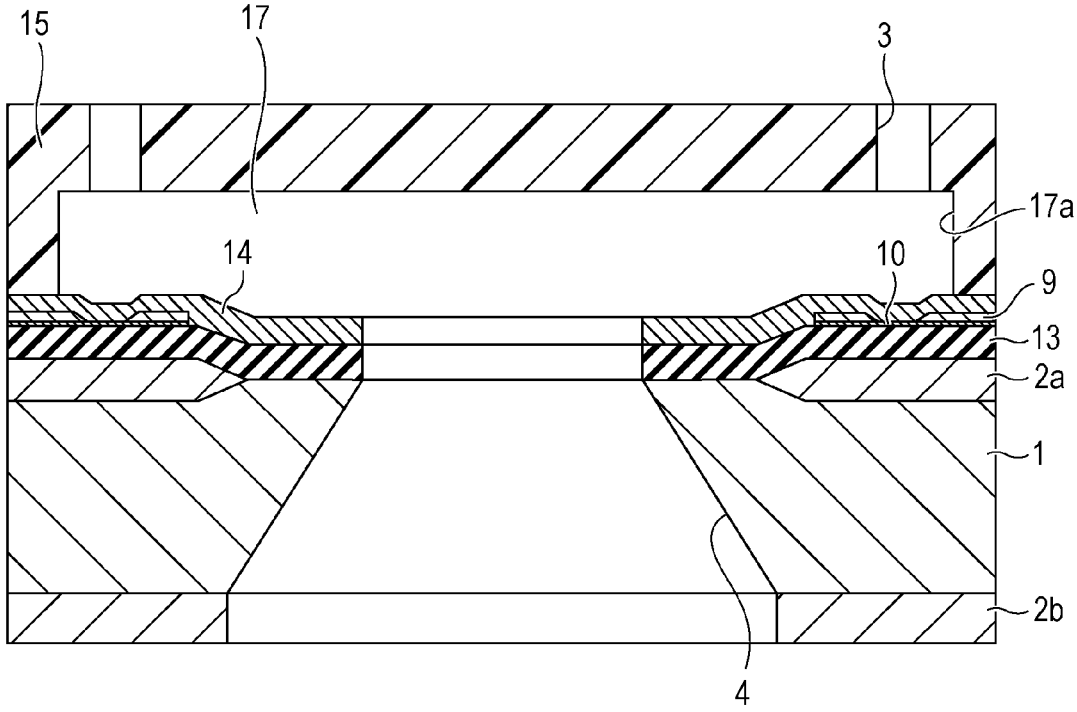
FIG. 3 is a schematic sectional view of the liquid discharge head taken along the line III-III of FIGS. 2A and 2B.

FIG. 2B is a schematic top view of a region around the supply port 4 of the liquid discharge head 41. In FIG. 2B, portions above the wall 17*a* of the passage 17 are omitted for simplification. FIG. 3 is a schematic sectional view of the liquid discharge head 41 taken along the line III-III of FIGS. 2A and 2B.

As shown in FIG. 3, a base substrate 1, made of silicon, having driving elements (not shown) such as transistors is overlaid with a thermal oxide layer 2*a* formed by thermally oxidizing a portion of the base substrate 1 and an interlayer insulation layer 13, formed by a CVD process, containing a silicon compound. A wiring layer (not shown) for driving the driving elements such as transistors, is placed between the thermal oxide layer 2*a* and the interlayer insulation layer 13. In some embodiments below, a material represented by the formula $Si_xC_yN_z$ is used to form the interlayer insulation layer 13. The interlayer insulation layer 13 functions as a heat storage layer for suppressing the distribution of heat generated by the energy-generating elements 23.

The interlayer insulation layer 13 is overlaid with a heat-generating resistive layer 10, made of a material such as TaSiN or WSiN, generating heat by energization. The heat-generating resistive layer 10 is placed in contact with a pair of electrodes 9 serving as wiring layer. The electrodes 9 are made of a material which is lower in resistance than the heat-generating resistive layer 10 and which mainly contains aluminium or the like.

The electrodes 9 are overlaid with a protective layer 14 for electrically or chemically protecting the electrodes 9 and the heat-generating resistive layer 10 from liquid. In some embodiments below, the material represented by the formula $Si_xC_yN_z$ is used to form the protective layer 14.

The protective layer 14 may be overlaid with one or more anti-cavitation layers (not shown), made of a metal material such as Ta or Ir, for protecting the energy-generating elements 23 from cavitation after bubbling.

The protective layer 14 is overlaid with the passage wall member 15. The passage wall member 15 has the wall 17*a*, which forms the passage 17 for supplying liquid to the energy-generating elements 23, and the discharge ports 3 for discharging liquid. In order to enhance the adhesion between the protective layer 14 and the passage wall member 15, an adhesive layer (not shown) made of a polyether amide resin or the like may be placed between the protective layer 14 and the passage wall member 15.

Figure 4:
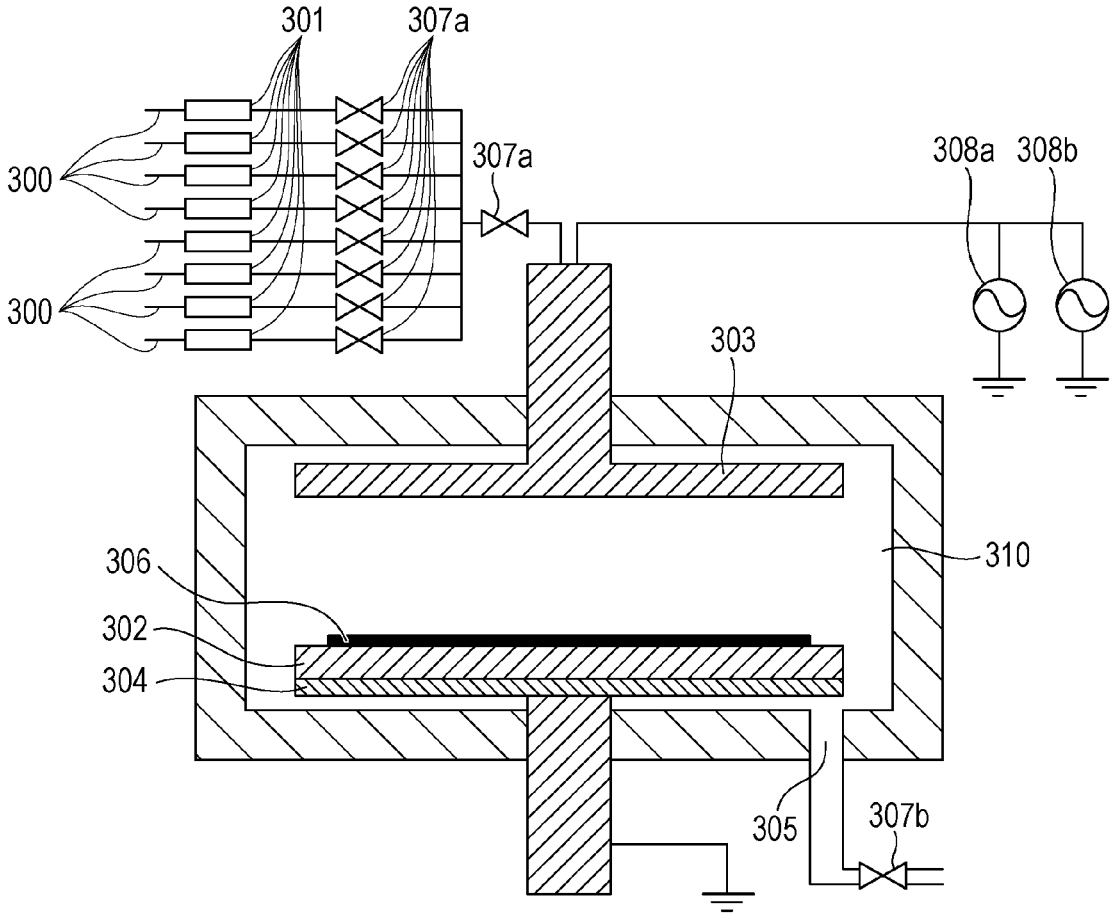
FIG. 4 is a schematic sectional view of a deposition chamber of a deposition system.

FIG. 4 is a schematic sectional view of a deposition chamber of a plasma-enhanced chemical vapor deposition (PECVD) system used in the present invention. A method for forming an $Si_xC_yN_z$ film is schematically described below with reference to FIG. 4. An $Si_xC_yN_z$ film according to the present invention is formed by a PECVD process.

First, the distance (GAP) between a shower head 303 and sample stage 302 functioning as an upper electrode and a lower electrode, respectively, during plasma discharge is determined by adjusting the height of the sample stage 302. The sample stage 302 is heated with a heater 304, whereby the temperature of the sample stage 302 adjusted.

Next, various gases used are introduced into the deposition chamber 310 through the shower head 303. In this operation, the flow rate of each of the gases is controlled with a corresponding one of mass flow controllers 301 attached to pipes 300 corresponding to the gases. Thereafter, the gases are mixed in a pipe and are supplied to the shower head 303 by opening introduction valves 307*a* corresponding to the gases. Subsequently, the amount of discharged gas is controlled by adjusting a vent valve 307*b* attached to a vent 305 communicating with a vacuum pump (not shown), whereby the pressure in the deposition chamber 310 is maintained constant. Thereafter, plasma is generated between the shower head 303 and the sample stage 302 using two-frequency RF power supplies 308*a* and 308*b*. Atoms dissociated in the plasma are deposited on a wafer 306, whereby a film is formed.

Conditions for forming the $Si_xC_yN_z$ film according to the present invention are appropriately selected from the followings.

Flow rate of $SiH_4$ gas: 20 sccm to 300 sccm
Flow rate of $NH_3$ gas: 10 sccm to 400 sccm
Flow rate of $N_2$ gas: 0 slm to 10 slm
Flow rate of $CH_4$ gas: 0.1 slm to 5 slm
HRF electric power: 200 W to 900 W
LRF electric power: 8 W to 500 W
Pressure: 310 Pa to 700 Pa
Temperature: 300° C. to 450° C.

$Si_xC_yN_z$ films having different compositions can be obtained in such a manner that the above conditions are adjusted and the flow rates of process gases such as $SiH_4$, $NH_3$, and $CH_4$ are varied. As a result, $Si_xC_yN_z$ films with levels of A to L shown in Table 1 have been capable of being obtained. However, when x<25, discharge has been incapable of being stably performed and therefore no film has been capable of being obtained. Herein, the content of each element in the $Si_xC_yN_z$ films is expressed on an atomic percent basis. Although an $Si_xC_yN_z$ film formed in the present invention contains hydrogen derived from source gases used in the above CVD process, the content of hydrogen therein is not taken into account. A film formed using the source gases usually contains about 15 atomic percent to 30 atomic percent of hydrogen. Hydrogen may be contained unless the content thereof significantly deviates from this range.

TABLE 1

| Sample | Flow rate of process gas | | | $Si_xC_yN_z$ | | |
|---|---|---|---|---|---|---|
| name | $SiH_4$ | $NH_3$ | $CH_4$ | x | y | z |
| A | 3 | 19 | 120 | 25 | 55 | 20 |
| B | 3.2 | 1.2 | 420 | 25 | 12 | 63 |
| C | 5 | 19 | 10 | 28 | 4 | 68 |
| D | 5.4 | 1.2 | 400 | 29 | 58 | 13 |
| E | 5.6 | 0.9 | 440 | 30 | 55 | 15 |
| F | 5.6 | 19 | 12 | 31 | 5 | 64 |
| G | 14 | 17 | 25 | 48 | 10 | 42 |
| H | 15.5 | 4.4 | 112 | 50 | 21 | 29 |
| I | 28 | 4.4 | 28 | 59 | 6 | 35 |
| J | 30 | 2.6 | 48 | 59 | 24 | 17 |
| K | 30 | 4.4 | 56 | 61 | 4 | 35 |
| L | 35 | 2.6 | 420 | 61 | 25 | 14 |

First Embodiment

In this embodiment, a material represented by the formula $Si_xC_yN_z$ is used to form a protective layer 14 shown in FIG. 3. Steps of manufacturing a liquid discharge head 41 according to this embodiment are described below in detail.

A base substrate 1 made of silicon is prepared. The base substrate 1 has a front surface having a thermal oxide layer 2*a* serving as a layer for isolating driving elements such as transistors and a back surface having a thermal oxide layer 2*b* used to form a mask for forming a supply port 4. A first wiring layer (not shown), having a thickness of about 200 nm to 500 nm, for supplying electric power for driving the driving elements from outside is provided on the front surface of the base substrate 1. The first wiring layer can be formed by a sputtering process and a dry etching process using a material (for example, an Al—Si alloy) mainly containing, for example, aluminium or using polysilicon. An interlayer insulation layer 13, made of silicon oxide, having a thickness of about 500 nm to 1 μm is provided on the first wiring layer by a CVD process or the like.

The following layers are provided on the interlayer insulation layer 13 by a sputtering process: a heat-generating resistive layer 10 which has a thickness of about 10 nm to 50 nm and which is made of TaSiN or WSiN and a second wiring layer which is used to form a pair of electrodes 9, which has a thickness of about 100 nm to 1.5 μm, and which mainly contains aluminium. The heat-generating resistive layer 10 and the second wiring layer are processed by a dry etching process and the second wiring layer is partly removed by a wet etching process, whereby the electrodes 9 are formed. Portions of the heat-generating resistive layer 10 that correspond to portions removed from the second wiring layer, that is, portions of the heat-generating resistive layer 10 that are located between the electrodes 9 are used as energy-generating elements 23.

A protective layer 14, made of $Si_xC_yN_z$, having a thickness of about 100 nm to 1 μm is provided over the substrate by a CVD process so as to cover the heat-generating resistive layer 10 and the electrodes 9. In this embodiment, the protective layer 14 is formed using one of $Si_xC_yN_z$ films, represented by A to L, having compositions shown in Table 1.

Through-holes used to supply electric power to the electrodes 9 from outside are formed by a dry etching process. Through the above steps, a substrate 5 for a liquid discharge head is obtained.

A soluble resin is applied to the substrate 5 for the liquid discharge head by a spin coating process and is patterned by photolithography, whereby a mold is formed on a portion used to form a passage 17. A cationically polymerizable epoxy resin is provided on the mold by a spin coating process and is then cured by baking using a hotplate, whereby a passage wall member 15 is formed. Portions corresponding to discharge ports 3 are removed from the passage wall member 15 by photolithography. The passage wall member 15 is protected with a cyclized rubber layer. The thermal oxide layer 2*b*, which is located opposed to a surface of the base substrate 1 that has the energy-generating elements 23, is bored so as to serve as a mask for forming a supply port 4.

The back surface of the base substrate 1 is wet-etched using a tetramethylammonium hydroxide (TMAH) solution, a potassium hydroxide (KOH) solution, or the like, whereby a through-hole serving as the supply port 4 is formed. When the base substrate 1 used is a single-crystalline silicon substrate with a (100) crystallographic surface orientation, the supply port 4 can be formed by crystallographic anisotropic etching using an alkaline solution (for example, a TMAH solution or a KOH solution). In the base substrate 1, the etching rate of the (111) plane is much lower than that of other crystallographic planes and therefore the supply port 4 can be formed so as to form an angle of about 54.7 degrees with a surface of the base substrate 1.

An exposed portion of the interlayer insulation layer 13 and the protective layer 14 are removed through the supply port 4 by a dry etching process. This step may be performed in such a manner that the interlayer insulation layer 13 is partly removed by wet etching using a buffered hydrofluoric acid (BHF) solution and the protective layer 14 is then partly removed by a dry etching process. Therefore, the cyclized rubber layer and the mold are removed, whereby the liquid discharge head 41 is completed.

Experiments performed to evaluate the performance of the $Si_xC_yN_z$ films, represented by A to L, shown in Table 1 are described below. In addition to the experiments, similar experiments were performed using conventional films, that is, a plasma SiN film and a plasma SiO film as Level M and Level N, respectively.

Experiment 1

In order to confirm the corrosion resistance of the $Si_xC_yN_z$ films described in the first embodiment to ink, an experiment below was performed. Each $Si_xC_yN_z$ film was formed on a silicon substrate. The substrate having the $Si_xC_yN_z$ film was fractured into pieces with a size of 20 mm×20 mm. One of the pieces was immersed in 30 cc of a pigment ink, heated to 70° C., having a pH of about 9 and was left for 72 hours and the dissolution amount thereof was measured. In this operation, in order to eliminate influences due to the dissolution of Si exposed at the back surface and end surfaces of the substrate, the back surface and side surfaces of the substrate was protected with a resin insoluble in ink. In this experiment, the thickness of the $Si_xC_yN_z$ film was measured by reflectance spectrometry using an optical interference-type thickness gauge.

In this experiment, the change in thickness of the $Si_xC_yN_z$ film was measured, whereby the corrosion resistance of the $Si_xC_yN_z$ film to ink was confirmed. The measurement results are shown in Table 2. In this experiment, judgment standards were as follows: the case where the dissolution amount was less than 1 nm was judged to be excellent, the case where the dissolution amount was 1 nm to less than 10 nm was judged to be good, the case where the dissolution amount was 10 nm to less than 300 nm was judged to be adequate, and the case where the dissolution amount was 300 nm or more was judged to be poor.

As used herein, the term "excellent" is applied to one that is very effective, the term "good" is applied to one that is effective, the term "adequate" is applied to one that is less effective, and the term "poor" is applied to one that is counter-effective. This applies to experiments below.

TABLE 2

| Sample | $Si_xC_yN_z$ | | | Dissolution amount in Experiment 1 | Evaluation of corrosion resistance in |
|---|---|---|---|---|---|
| name | x | y | z | (nm) | Experiment 1 |
| A | 25 | 55 | 20 | 0.2 | Excellent |
| B | 25 | 12 | 63 | 0.9 | Excellent |
| C | 28 | 4 | 68 | 15.4 | Adequate |
| D | 29 | 58 | 13 | 0 | Excellent |
| E | 30 | 55 | 15 | 0 | Excellent |
| F | 31 | 5 | 64 | 3.5 | Good |
| G | 48 | 10 | 42 | 1.6 | Good |
| H | 50 | 21 | 29 | 0.4 | Excellent |
| I | 59 | 6 | 35 | 3.2 | Good |
| J | 59 | 24 | 17 | 0.2 | Excellent |
| K | 61 | 4 | 35 | 19.2 | Adequate |
| L | 61 | 25 | 14 | 0.2 | Excellent |
| M | P—SiN | | | 198 | Adequate |
| N | P—SiO | | | 226 | Adequate |

From the results shown in Table 2, it is clear that the $Si_xC_yN_z$ films meeting the corrosion resistance to ink have a composition satisfying the formulae x+y+z=100 (atomic percent), x>0, y≥5 (atomic percent), and z>0. In particular, in the case of using the pigment ink, it is effective to use an $Si_xC_yN_z$ film having such a composition. Substantially the same results as the above results are obtained even if a pigment ink or die ink with a pH of about 5 to 11 is used.

Experiment 2

In order to confirm the adhesion between the $Si_xC_yN_z$ film and passage wall member 15 described in the first embodiment, an experiment below was performed. Liquid discharge heads 41 obtained in the above examples and comparative examples were each immersed in 30 cc of a pigment ink with a pH of about 9 and were subjected to pressure cooker testing (PCT) at 121° C. for ten hours in a 100% RH atmosphere. Thereafter, the surface of each liquid discharge head 41 was observed with a microscope.

In this experiment, the delamination of passage wall members 15 was investigated, whereby the adhesion between $Si_xC_yN_z$ films and the passage wall members 15 was confirmed. In this experiment, judgment standards were as follows: one in which the delamination of a passage wall member 15 was not observed at all was judged to be excellent, one in which a passage wall member 15 was not delaminated and was partly lifted was judged to be good, one in which a passage wall member 15 was delaminated and was partly lost was judged to be adequate, and one in which a passage wall member 15 was completely lost was judged to be poor.

TABLE 3

| Sample | $Si_xC_yN_z$ | | | Evaluation by PCT test |
|---|---|---|---|---|
| name | x | y | z | in Experiment 2 |
| A | 25 | 55 | 20 | Poor |
| B | 25 | 12 | 63 | Poor |
| C | 28 | 4 | 68 | Adequate |
| D | 29 | 58 | 13 | Adequate |
| E | 30 | 55 | 15 | Good |
| F | 31 | 5 | 64 | Good |
| G | 48 | 10 | 42 | Good |
| H | 50 | 21 | 29 | Good |
| I | 59 | 6 | 35 | Good |
| J | 59 | 24 | 17 | Excellent |
| K | 61 | 4 | 35 | Excellent |
| L | 61 | 25 | 14 | Excellent |
| M | P—SiN | | | Good |
| N | P—SiO | | | Excellent |

From the results shown in Table 3, it is clear that the $Si_xC_yN_z$ films meeting the adhesion to a passage wall member 15 have a composition satisfying the formulae x+y+z=100 (atomic percent), x≥30 (atomic percent), y>0, and z>0. In particular, in the case of using the pigment ink, it is effective to use an $Si_xC_yN_z$ film having such a composition. Substantially the same results as the above results are obtained even if a pigment ink or die ink with a pH of about 5 to 11 is used.

Experiment 3

In order to confirm the electrical insulation of the $Si_xC_yN_z$ film described in the first embodiment, an experiment below was performed. A metal layer, used as a first electrode, mainly containing aluminium was formed on each of silicon substrates having a thermal silicon oxide layer with a thickness of 1 μm so as to have a thickness of 600 nm and was then processed so as to have a size of 2.5 mm×2.5 mm. An $Si_xC_yN_z$ film is formed thereon so as to have a thickness of 300 nm. A layer, used as a second electrode, mainly containing aluminium was formed thereon so as to have a thickness of 600 nm and a size of 2.5 mm×2.5 mm and so as not to protrude outside the first electrode. In order to make an electrical contact with the first electrode, a through-hole was bored in the $Si_xC_yN_z$ film. Such a sample was used to measure the current flowing when a voltage of 20 V was applied between the first electrode and the second electrode.

In this experiment, the electrical insulation of the $Si_xC_yN_z$ film was confirmed by measuring the current. The measurement results are shown in Table 4. In this experiment, judgment standards were as follows: one in which the current was less than 10 nA was judged to be excellent, one in which the current was 10 nA to less than 500 nA was judged to be good, one in which the current was 500 nA to less than 1 μA was judged to be adequate, and one in which the current was 1 μA or more was judged to be poor.

TABLE 4

| Sample | $Si_xC_yN_z$ | | | Current in | Evaluation of current |
|---|---|---|---|---|---|
| name | x | y | z | Experiment 3 (nA) | in Experiment 3 |
| A | 25 | 55 | 20 | 0.31 | Excellent |
| B | 25 | 12 | 63 | 0.13 | Excellent |
| C | 28 | 4 | 68 | 0.25 | Excellent |
| D | 29 | 58 | 13 | 0.44 | Excellent |
| E | 30 | 55 | 15 | 0.22 | Excellent |
| F | 31 | 5 | 64 | 0.13 | Excellent |
| G | 48 | 10 | 42 | 0.79 | Excellent |
| H | 50 | 21 | 29 | 0.88 | Excellent |
| I | 59 | 6 | 35 | 330 | Good |
| J | 59 | 24 | 17 | 70.3 | Good |

TABLE 4-continued

| Sample name | $Si_xC_yN_z$ x | y | z | Current in Experiment 3 (nA) | Evaluation of current in Experiment 3 |
|---|---|---|---|---|---|
| K | 61 | 4 | 35 | 1264 | Poor |
| L | 61 | 25 | 14 | 756 | Adequate |
| M | P—SiN | | | 0.49 | Excellent |
| N | P—SiO | | | 0.89 | Excellent |

From the results shown in Table 4, it is clear that the $Si_xC_yN_z$ films meeting the electrical insulation have a composition satisfying the formulae x+y+z=100 (atomic percent), x≤59 (atomic percent), y>0, and z>0.

Experiment 4

In order to confirm the processability of an $Si_xC_yN_z$ film according to the present invention, an experiment below was performed. An $Si_xC_yN_x$ film was formed on each of silicon substrates and was measured for etching rate in such a manner that the $Si_xC_yN_x$ film was etched with a gas mixture of carbon tetrafluoride, oxygen, argon, and trifluoromethane ($CHF_3$). A method for measuring the thickness thereof is the same as that described in Experiment 1.

In this experiment, the processability of the $Si_xC_yN_z$ film was confirmed by measuring the etching rate thereof. The measurement results are shown in Table 5. In this experiment, judgment standards were as follows: one in which the etching rate was 200 nm/min or more was judged to be excellent, one in which the etching rate was 100 nm/min or more to less than 200 nm/min was judged to be good, one in which the etching rate was 50 nm/min or more to less than 100 nm/min was judged to be adequate, and one in which the etching rate was less than 50 nm/min was judged to be poor.

TABLE 5

| Sample name | $Si_xC_yN_z$ x | y | z | Etching rate in Experiment 4 (nm/min) | Evaluation of etching rate in Experiment 4 |
|---|---|---|---|---|---|
| A | 25 | 55 | 20 | 121.1 | Good |
| B | 25 | 12 | 63 | 284.0 | Excellent |
| C | 28 | 4 | 68 | 254.4 | Excellent |
| D | 29 | 58 | 13 | 87.7 | Adequate |
| E | 30 | 55 | 15 | 108.3 | Good |
| F | 31 | 5 | 64 | 231.4 | Excellent |
| G | 48 | 10 | 42 | 220.8 | Excellent |
| H | 50 | 21 | 29 | 151.4 | Good |

TABLE 5-continued

| Sample name | $Si_xC_yN_z$ x | y | z | Etching rate in Experiment 4 (nm/min) | Evaluation of etching rate in Experiment 4 |
|---|---|---|---|---|---|
| I | 59 | 6 | 35 | 143.1 | Good |
| J | 59 | 24 | 17 | 104.5 | Good |
| K | 61 | 4 | 35 | 131.4 | Good |
| L | 61 | 25 | 14 | 36.2 | Poor |
| M | P—SiN | | | 153.1 | Good |
| N | P—SiO | | | 3.5 | Poor |

From the results shown in Table 5, it is clear that the $Si_xC_yN_z$ films meeting processability have a composition satisfying the formulae x+y+z=100 (atomic percent), x>0, y>0, and z≥15 (atomic percent).

The results of Experiments 1 to 4 are summarized in Table 6. The lowest rating among the results of each experiment was used for overall judgment. Levels comprehensively judged to be good are E to J.

Figure 5:
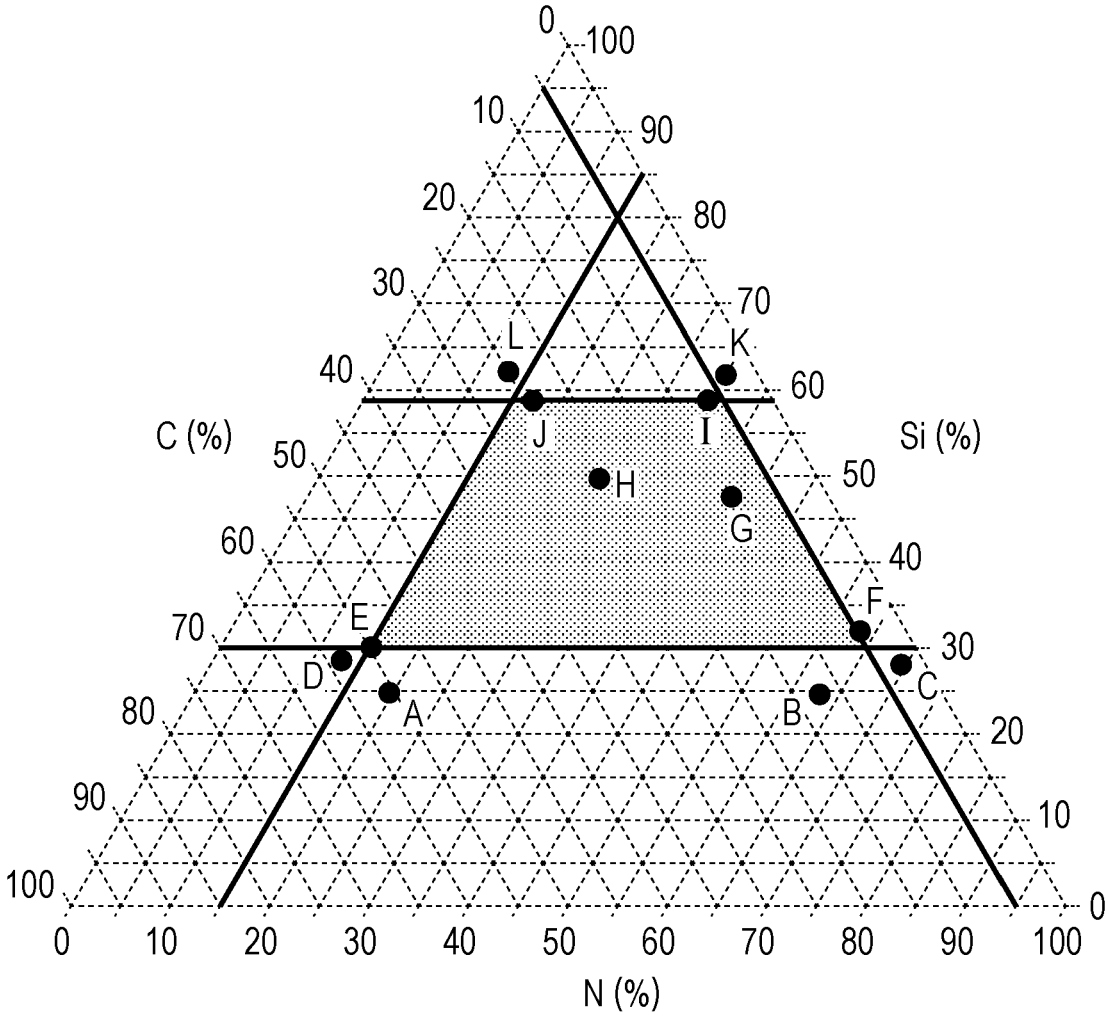
FIG. 5 is a ternary graph illustrating the composition region of an $Si_xC_yN_z$ film according to an embodiment of the present invention and the composition of an $Si_xC_yN_z$ film used in each experiment.

A protective layer 14 of a substrate 5 for a liquid discharge head needs to have performance described in Experiments 1 to 4. From the results of each experiment, it is clear that the composition of an $Si_xC_yN_z$ film, suitable as a protective layer 14, meeting such performance satisfies the formulae x+y+z=100 (atomic percent), 30≤x≤59 (atomic percent), y≥5 (atomic percent), and z≥15 (atomic percent). FIG. 5 is a ternary graph illustrating the composition thereof.

TABLE 6

| Sample name | $Si_xC_yN_z$ x | y | z | Corrosion resistance | Adhesion | Insulation | Processability | Overall judgment |
|---|---|---|---|---|---|---|---|---|
| A | 25 | 55 | 20 | Excellent | Poor | Excellent | Good | Poor |
| B | 25 | 12 | 63 | Excellent | Poor | Excellent | Excellent | Poor |
| C | 28 | 4 | 68 | Adequate | Adequate | Excellent | Excellent | Adequate |
| D | 29 | 58 | 13 | Excellent | Adequate | Excellent | Adequate | Adequate |
| E | 30 | 55 | 15 | Excellent | Good | Excellent | Good | Good |
| F | 31 | 5 | 64 | Good | Good | Excellent | Excellent | Good |
| G | 48 | 10 | 42 | Good | Good | Excellent | Excellent | Good |
| H | 50 | 21 | 29 | Excellent | Good | Excellent | Good | Good |
| I | 59 | 6 | 35 | Good | Good | Good | Good | Good |
| J | 59 | 24 | 17 | Excellent | Excellent | Good | Good | Good |
| K | 61 | 4 | 35 | Adequate | Excellent | Poor | Good | Poor |
| L | 61 | 25 | 14 | Excellent | Excellent | Adequate | Poor | Adequate |
| M | P—SiN | | | Adequate | Good | Excellent | Good | Adequate |
| N | P—SiO | | | Adequate | Excellent | Excellent | Poor | Adequate |

Liquid was actually discharged from liquid discharge heads 41 prepared in the first embodiment. As a result, liquid discharge heads 41 including protective layers 14 with levels of E to J shown in Table 6 were free from failures due to the dissolution of a protective layer 14, the delamination of a passage wall member 15, and electrical failures. Liquid discharge heads 41 having excellent processability were capable of being obtained.

On the other hand, liquid discharge heads 41 with levels of A, B, and C had failures due to the delamination of passage wall members 15. For levels of D and L, the etching residue of a film was caused in a step of boring a protective layer 14 and therefore a liquid discharge head 41 was not capable of being driven. For a level of K, a current was generated between wiring lines due to a leakage current and therefore discharge performance was significantly reduced.

For heads of M and N, although no failures occurred, the dissolution of a protective layer 14 and an interlayer insulation layer 13 was observed. In a step of etching plasma SiO for preparing the head of N, processing by dry etching was incapable and therefore a wet etching process using a BHF solution was used.

Second Embodiment

When ink flows through a supply port 4 formed in a substrate 5 for a liquid discharge head, the ink contacts with a portion of an interlayer insulation layer 13, a plasma SiO film used as the interlayer insulation layer 13 may possibly be dissolved depending on ink used. In particular, if the distance between the supply port 4 and each energy-generating element 23 is reduced for the purpose of downsizing the substrate 5 for the liquid discharge head, the dissolution of the interlayer insulation layer 13 is likely to reach the position of the energy-generating element 23 and therefore may possibly cause disconnection.

Therefore, in this embodiment, a material represented by the formula $Si_xC_yN_z$ is used to form the interlayer insulation layer 13 in addition to a protective layer 14. Substantially the same members or manufacturing steps as those described in the first embodiment will not be described.

In this embodiment, the interlayer insulation layer 13 and the protective layer 14 use $Si_xC_yN_z$ films with the same composition level. The interface between the interlayer insulation layer 13 and the protective layer 14 is strongly bonded by the use of a material with the same composition level. Therefore, a substrate 5 for a liquid discharge head having high reliably can be provided.

Steps of manufacturing a liquid discharge head 41 according to this embodiment are different in a step of providing the interlayer insulation layer 13 from those described in the first embodiment. In particular, the interlayer insulation layer 13 is provided on a first wiring layer by a CVD process or the like. The interlayer insulation layer 13 is made of $Si_xC_yN_z$ and has a thickness of about 100 nm to 1 μm. In this embodiment, the interlayer insulation layer 13 is formed using one of $Si_xC_yN_z$ films, represented by A to L, having compositions shown in Table 1.

The $Si_xC_yN_z$ films according to the second embodiment have been investigated for corrosion resistance to ink, adhesion to a passage wall member 15, insulation, and processability by Experiments 1 to 4 described above. Performance necessary for the $Si_xC_yN_z$ films according to this embodiment is substantially the same as that described in the first embodiment. For all the experiments, levels judged to be excellent or good are E to J. From the results of Experiments 1 to 4, in the second embodiment, it is clear that the preferred composition of the $Si_xC_yN_z$ films satisfies the formulae $x+y+z=100$ (atomic percent), $30 \leq x \leq 59$ (atomic percent), $y \geq 5$ (atomic percent), and $z \geq 15$ (atomic percent). The composition thereof is substantially the same as a region obtained in the first embodiment, that is, a composition region shown in FIG. 5.

Ink was actually discharged from liquid discharge heads 41 prepared in the first embodiment. As a result, liquid discharge heads 41 including interlayer insulation layers 13 and protective layers 14 with levels of E to J shown in Table 6 were free from failures due to the dissolution of these layers, electrical failures, and the delamination of a passage wall member 15. Liquid discharge heads 41 having excellent processability were capable of being obtained.

On the other hand, liquid discharge heads 41 with levels of A, B, and C had failures due to the delamination of passage wall members 15. For levels of D and L, the etching residue of a film was caused in a step of boring a protective layer 14 and therefore failures occurred in a step of forming a passage wall member 15. For a level of K, a current was generated between wiring lines due to a leakage current and therefore a liquid discharge head 41 was incapable of being driven.

For heads of M and N, although no failures occurred, the dissolution of a protective layer 14 and an interlayer insulation layer 13 was observed. In a step of etching plasma SiO for preparing the head of N, processing by dry etching was incapable and therefore a wet etching process using a BHF solution was used.

Another Embodiment

This embodiment is intended to solve the issue of reducing the dissolution of an interlayer insulation layer 13 in ink. Thus, in this embodiment, a material represented by the formula $Si_xC_yN_z$ is used to form the interlayer insulation layer 13; however, a material used to form a protective layer 14 is not particularly limited. Substantially the same members or manufacturing steps as those described in the above embodiments will not be described.

In this embodiment, the interlayer insulation layer 13 is provided on a first wiring layer by a CVD process or the like. The interlayer insulation layer 13 is made of $Si_xC_yN_z$ and has a thickness of about 100 nm to 1 μm. The interlayer insulation layer 13 is formed using one of $Si_xC_yN_z$ films, represented by A to L, having compositions shown in Table 1 so as to have a thickness of about 100 nm to 1 μm.

The protective layer 14 is provided over a substrate by a CVD process so as to cover a heat-generating resistive layer 10 and a pair of electrodes 9 formed on the interlayer insulation layer 13. The protective layer 14 is made of plasma SiN and has a thickness of about 100 nm to 1 μm.

A interlayer insulation layer 13 of a substrate 5 for a liquid discharge head needs to have corrosion resistance, insulation, and processability. Therefore, in this embodiment, $Si_xC_yN_z$ films as interlayer insulation layers 13 have been investigated for corrosion resistance to ink, insulation, and processability by Experiments 1, 3, and 4 described above. Results of experiments for evaluating performance necessary in this embodiment are summarized in Table 7. For all the experiments, levels judged to be excellent or good are A, B, and E to J.

Figure 6:
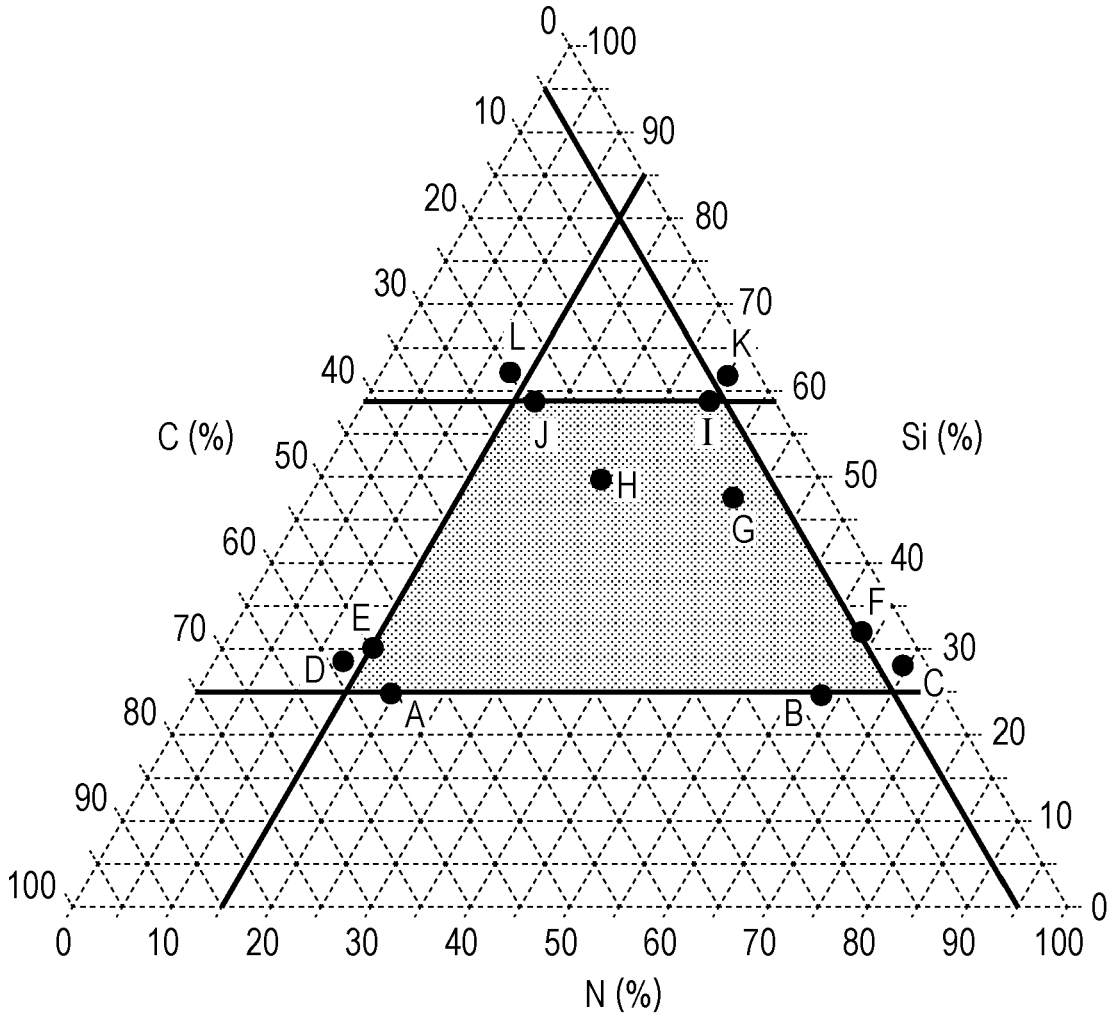
FIG. 6 is a ternary graph illustrating the composition region of an $Si_xC_yN_z$ film according to another embodiment of the present invention and the composition of an $Si_xC_yN_z$ film used in each experiment.

From the results of Experiments 1, 3, and 4, in this embodiment, it is clear that the preferred composition of the $Si_xC_yN_z$ films as the interlayer insulation layers 13 satisfies the formulae $x+y+z=100$ (atomic percent), $0<x \leq 59$ (atomic percent), $y \geq 5$ (atomic percent), and $z \geq 15$ (atomic percent). However, under deposition conditions supposed to cause $x<25$, discharge was incapable of being stably performed and therefore no film was capable of being formed. In consideration of a region capable of stably forming a film, in the second embodiment, it is clear that the preferred composition of an $Si_xC_yN_z$ films as an interlayer insulation layer 13 satisfies the formulae $x+y+z=100$ (atomic percent), $25 \leq x \leq 59$ (atomic percent), $y \geq 5$ (atomic percent), and $z \geq 15$ (atomic percent). FIG. 6 is a ternary graph illustrating the composition thereof.

TABLE 7

| Sample | $Si_xC_yN_z$ | | | Corrosion | | | Overall |
|---|---|---|---|---|---|---|---|
| name | x | y | z | resistance | Insulation | Processability | judgment |
| A | 25 | 55 | 20 | Excellent | Excellent | Good | Good |
| B | 25 | 12 | 63 | Excellent | Excellent | Excellent | Excellent |
| C | 28 | 4 | 68 | Adequate | Excellent | Excellent | Adequate |
| D | 29 | 58 | 13 | Excellent | Excellent | Adequate | Adequate |
| E | 30 | 55 | 15 | Excellent | Excellent | Good | Good |

TABLE 7-continued

| Sample name | $Si_xC_yN_z$ x | y | z | Corrosion resistance | Insulation | Processability | Overall judgment |
|---|---|---|---|---|---|---|---|
| F | 31 | 5 | 64 | Good | Excellent | Excellent | Good |
| G | 48 | 10 | 42 | Good | Excellent | Excellent | Good |
| H | 50 | 21 | 29 | Excellent | Excellent | Good | Good |
| I | 59 | 6 | 35 | Good | Good | Good | Good |
| J | 59 | 24 | 17 | Excellent | Good | Good | Good |
| K | 61 | 4 | 35 | Adequate | Poor | Good | Poor |
| L | 61 | 25 | 14 | Excellent | Adequate | Poor | Adequate |
| M | P—SiN | | | Adequate | Excellent | Good | Adequate |
| N | P—SiO | | | Adequate | Excellent | Poor | Adequate |

Liquid was actually discharged from liquid discharge heads 41 prepared in this embodiment. As a result, liquid discharge heads 41 including interlayer insulation layers 13 with levels of A, B, and E to J shown in Table 6 were free from failures due to the dissolution of a interlayer insulation layer 13 and electrical failures. Liquid discharge heads 41 having excellent processability were capable of being obtained.

On the other hand, for levels of D and L, the etching residue of a film was caused in a step of boring a supply port 4 and therefore failures occurred in a step of forming a passage wall member 15. For a level of K, a current was generated between wiring lines due to a leakage current and therefore a liquid discharge head 41 was incapable of being driven.

For heads of C, M, and N, although no failures occurred, the dissolution of a protective layer 14 and an interlayer insulation layer 13 was observed. In a step of etching plasma SiO for preparing the head of N, processing by dry etching was incapable and therefore a wet etching process using a BHF solution was used.

In the case of using a material represented by the formula $Si_xC_yN_z$ to form both an interlayer insulation layer 13 and a protective layer 14, $Si_xC_yN_z$ films having composition levels different from each other between these layers. In this case, the composition level of the protective layer 14 and the composition level of the interlayer insulation layer 13 may be achieved using an $Si_xC_yN_z$ film within a range shown in FIG. 5 and an $Si_xC_yN_z$ film within a range shown in FIG. 6 in combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-116935 filed May 22, 2012 and No. 2013-089846 filed Apr. 22, 2013, which are hereby incorporated by reference herein in their entirety.

What is claimed is:

1. A substrate for a liquid discharge head, comprising:

a base substrate;

a heat-generating resistive layer placed on or above the base substrate;

a pair of lines placed on or above the base substrate and contacted with the heat-generating resistive layer; and a protective layer covering the heat-generating resistive layer and the lines, wherein the protective layer contains a material represented by the formula $Si_xC_yN_z$, where $x+y+z=100$, $30 \leq x \leq 59$, $y \geq 5$, and $z \geq 15$ on an atomic percent basis.

2. The substrate for the liquid discharge head according to claim 1, further comprising:

a wiring layer including the lines;

another wiring layer which is different from the wiring layer and which is placed on the base substrate; and an insulation layer placed between the wiring layer and the other wiring layer, wherein the insulation layer contains a material represented by the formula $Si_xC_yN_z$, where $x+y+z=100$, $25 \leq x \leq 59$, $y \geq 5$, and $z \geq 15$ on an atomic percent basis.

3. The substrate for the liquid discharge head according to claim 2, wherein the protective layer and the insulation layer have portions in contact with each other and the material in the protective layer and the material in the insulation layer have the same composition.

4. The substrate for the liquid discharge head according to claim 1, further comprising another protective layer which is different from the protective layer and which covers a portion, located between the lines, corresponding to the heat-generating resistive layer.

5. A liquid discharge head comprising:

a substrate including a base substrate, a heat-generating resistive layer placed on or above the base substrate, a pair of lines placed on or above the base substrate and contacted with the heat-generating resistive layer, and a protective layer covering the heat-generating resistive layer and the lines; and a passage-forming member, including a portion which is in contact with the protective layer and which contains resin, for forming a passage where ink flows, wherein the protective layer contains a material represented by the formula $Si_xC_yN_z$, where $x+y+z=100$, $30 \leq x \leq 59$, $y \geq 5$, and $z \geq 15$ on an atomic percent basis.

6. The liquid discharge head according to claim 5, wherein the protective layer includes a portion serving as the passage.

* * * * *